US010085541B2

(12) United States Patent
Wells

(10) Patent No.: US 10,085,541 B2
(45) Date of Patent: Oct. 2, 2018

(54) NAIL POLISH REMOVER IN A SPRAY BOTTLE WITH FILE ATTACHMENT

(71) Applicant: Yolanda Racquel Wells, Williamstown, NJ (US)

(72) Inventor: Yolanda Racquel Wells, Williamstown, NJ (US)

( * ) Notice: Subject to any disclaimer, the term of this patent is extended or adjusted under 35 U.S.C. 154(b) by 363 days.

(21) Appl. No.: 14/948,303

(22) Filed: Nov. 21, 2015

(65) Prior Publication Data

US 2016/0150865 A1 Jun. 2, 2016

Related U.S. Application Data

(60) Provisional application No. 62/082,986, filed on Nov. 21, 2014.

(51) Int. Cl.

| | |
|---|---|
| ***A45D 29/00*** | (2006.01) |
| ***A45D 34/04*** | (2006.01) |
| ***A45D 34/06*** | (2006.01) |
| ***A45D 29/04*** | (2006.01) |

(52) U.S. Cl.

CPC ..... *A45D 34/046* (2013.01); *A45D 29/007* (2013.01); *A45D 29/04* (2013.01); *A45D 34/04* (2013.01); *A45D 34/042* (2013.01); *A45D 34/06* (2013.01); *A45D 2200/057* (2013.01)

(58) Field of Classification Search

CPC ..... A45D 29/007; A45D 29/04; A45D 34/04; A45D 34/042; A45D 34/043; A45D 34/045; A45D 34/046; A45D 2200/057; A45D 34/06

See application file for complete search history.

(56) References Cited

U.S. PATENT DOCUMENTS

| | | | | |
|---|---|---|---|---|
| 4,964,372 | A * | 10/1990 | Zeenni | A45D 29/007 132/74.5 |
| 6,148,828 | A * | 11/2000 | Bourassa | A45D 29/007 132/73.5 |
| 2004/0190974 | A1* | 9/2004 | Cantone | A45D 29/007 401/25 |
| 2004/0234321 | A1* | 11/2004 | Breidenbach | A45D 34/06 401/21 |
| 2005/0056343 | A1* | 3/2005 | Gueret | A45D 34/042 141/349 |

(Continued)

*Primary Examiner* — Ryan A Reis

(74) *Attorney, Agent, or Firm* — Ash Tankha; Lipton, Weinberger & Husick

(57) ABSTRACT

A spray bottle for storing a nail polish remover with a nail file attachment is provided. The spray bottle includes an upper container, a middle container, and a bottom container for storing a nail polish remover, cosmetic items, and refills of an absorbent cleaning material respectively. The spray bottle includes a spray attachment for dispensing the nail polish remover to the absorbent cleaning material attached to an adhering surface of a sprayer of the spray attachment. The sprayer sprays a required amount of the nail polish remover on one or more nails and allows removal of the nail polish from one or more nails without ruining adjacent painted nails and without spilling. After usage, the absorbent cleaning material is discarded and replaced with another absorbent cleaning material stored in the bottom container. The nail file attachment is attached to the bottom container. The nail file attachment is disposable and replaceable.

3 Claims, 5 Drawing Sheets

(56) References Cited

U.S. PATENT DOCUMENTS

| | | | | |
|---|---|---|---|---|
| 2008/0138138 | A1* | 6/2008 | Gueret | A45D 34/04<br>401/24 |
| 2008/0273915 | A1* | 11/2008 | O'Connell | A45D 34/04<br>401/188 R |
| 2011/0268490 | A1* | 11/2011 | Acierto | A45D 34/04<br>401/37 |
| 2012/0283668 | A1* | 11/2012 | Shalev | A45D 34/04<br>604/290 |

* cited by examiner

NAIL POLISH REMOVER IN A SPRAY BOTTLE WITH FILE ATTACHMENT

CROSS-REFERENCE TO RELATED APPLICATIONS

This application claims priority to and the benefit of the provisional patent application No. 62/082,986 titled "Nail polish remover in a spray bottle with a cap that holds the removable fiber.", filed in the United States Patent and Trademark Office on Nov. 21, 2014. The specification of the above referenced patent application is incorporated herein by reference in its entirety.

FIELD OF THE INVENTION

The present invention relates to a nail polish remover. More particularly, the present invention relates to a nail polish remover in a spray bottle with a nail file attachment.

BACKGROUND

Conventional methods for removing nail polish from nails include use of cotton balls or wipes, inserting fingers into a container or a jar containing a sponge filled with a nail polish remover, etc. Conventional nail polish removers typically remove nail polish from nails in a messy and/or unsanitary manner. Cotton balls with a nail polish remover poured on them stick to or ruin other adjacent painted nails. When using individual wipes, the user may not have enough of the nail polish remover on the individual wipes, leaving no control over the amount of the nail polish remover used. A container with a sponge positioned inside the container requires a user to insert a finger into the container, which makes the sponge unclean, and also unsanitary for sharing with other users, for example, children even after a first use. Disposable packs do not contain enough nail polish remover to completely remove the nail polish from the nails. Other products are not efficient and are unsanitary for cleaning the nails. These products create a mess and can inadvertently remove nail polish from other adjacent painted nails. Typically, when users such as women and girls polish their nails, if they make a mistake on a single nail, they have to try removing the nail polish on that single nail without ruining the nail polish on the other adjacent painted nails. Moreover, the nail polish remover in these products spill down a user's hand and on personal items such as clothes when the user tries to use a small amount of the nail polish remover on a swab or when the user tries to use the nail polish remover in a moving vehicle, making these products inconvenient during travel. Furthermore, removal of nail polish from the nails is typically followed by filing the nails and applying lotion on the nails.

Hence, there is a long felt but unresolved need for a spray bottle containing a nail polish remover that allows a user to remove nail polish from one or more nails without ruining other adjacent painted nails and without spilling the nail polish remover. Moreover, there is a need for a spray bottle containing a nail polish remover that allows a user to spray a required amount of the nail polish remover on the nails. Furthermore, there is a need for a spray bottle containing a nail polish remover and a nail file attachment that allows a user to file the nails after removal of the nail polish from the nails. Furthermore, there is a need for a spray bottle containing receptacles for storing cosmetic items, for example, lotions, creams, etc., and refills of an absorbent cleaning material.

SUMMARY OF THE INVENTION

The present invention disclosed herein addresses the above recited need for a spray bottle containing a nail polish remover that allows a user to remove nail polish from one or more nails without ruining other adjacent painted nails and without spilling the nail polish remover, for example, on the user's hands, clothes, etc. Moreover, the present invention disclosed herein addresses the above recited need for a spray bottle containing a nail polish remover that allows a user to spray a required amount of the nail polish remover on the nails. Furthermore, the present invention disclosed herein addresses the above recited need for a spray bottle containing a nail polish remover and a nail file attachment positioned at a bottom end of the spray bottle that allows a user to file nails after removal of the nail polish from the nails. Furthermore, the present invention disclosed herein addresses the above recited need for a spray bottle containing receptacles for storing cosmetic items, for example, lotions, creams, etc., and refills of an absorbent cleaning material. The apparatus disclosed herein comprises an absorbent cleaning material installed on an adhering surface of a sprayer of the spray bottle. The absorbent cleaning material can be replaced after every use. The apparatus disclosed herein keeps all manicuring needs in one place.

BRIEF DESCRIPTION OF THE DRAWINGS

The foregoing summary, as well as the following detailed description of the invention, is more completely understood when read in conjunction with the appended drawings. For illustrating the invention, exemplary constructions of the invention are shown in the drawings.

REFERENCE NUMERALS IN THE DRAWINGS

For a more complete understanding of the parts of the present invention, reference is now made to the following descriptions:

1—Cap
2—Threaded neck
3—Sprayer
4—External spray hole
5—Absorbent cleaning material
6—Pump tube attachment
7—Upper container
8—Middle internal reservoir
9—Threaded structure
10—Middle container
11—Threaded structure
12—Nail file attachment
13—Pump tube mechanism
14—Cap rim
15—Top lid

16—Tubing
17—Bottom internal reservoir
18—Adhering surface
19—Bottom container
20—Top internal reservoir

DETAILED DESCRIPTION OF THE INVENTION

The following detailed description sets forth the best currently contemplated modes of carrying out exemplary embodiments of the invention. The description is not to be taken in a limiting sense, but is merely for the purpose of illustrating the general principles of the invention.

Figure 1:
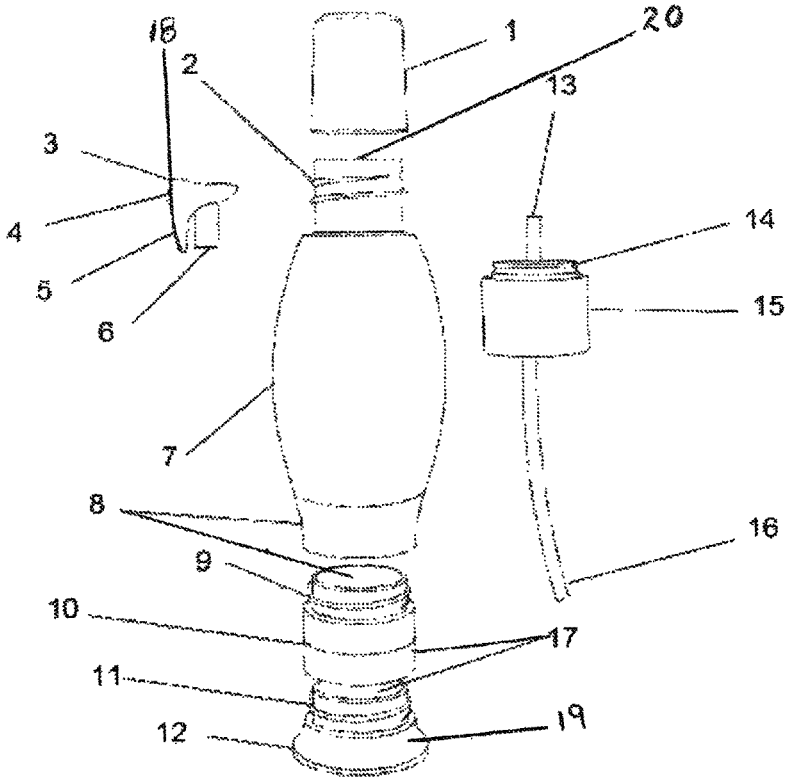
FIG. 1 exemplarily illustrates an exploded view of a spray bottle for storing a nail polish remover, a nail file attachment, and refills of an absorbent cleaning material.

FIG. 1 exemplarily illustrates an exploded view of a spray bottle for storing a nail polish remover, a nail file attachment 12, and refills of an absorbent cleaning material 5. The spray bottle disclosed herein comprises multiple containers 7, 10, and 19, a spray attachment, the nail file attachment 12, and a cap 1. The containers comprise an upper container 7, a middle container 10, and a bottom container 19. The upper container 7 comprises a top internal reservoir 20 with a threaded neck 2. The upper container 7 stores the nail polish remover. The middle container 10 comprises a middle internal reservoir 8. The middle container 10 is screwably attached to a lower end of the upper container 7 via a threaded structure 9. The middle container 10 stores one or more cosmetic items such as lotions, cosmetic creams, etc. The bottom container 19 comprises a bottom internal reservoir 17. The bottom container 19 is screwably attached to a lower end of the middle container 10 via a threaded structure 11. The bottom container 19 stores refills of the absorbent cleaning material 5. In an embodiment, the absorbent cleaning material 5 is, for example, a disposable fiber. The spray attachment is screwably attached to the top internal reservoir 20. The spray attachment comprises a top lid 15 and a sprayer 3 with a pump tube attachment 6. The top lid 15 comprises a cap rim 14 on an upper surface of the top lid 15. The top lid 15 mates with the threaded neck 2 of the top internal reservoir 20. The pump tube attachment 6 is coupled to a pump tube mechanism 13. The pump tube mechanism 13 engages with the top lid 15. A tubing 16 is attached to the top lid 15 at a first end. The tubing 16 is immersed into the nail polish remover at a second end. The sprayer 3 further comprises an adhering surface 18 with a spray hole 4. The absorbent cleaning material 5 is positioned on the adhering surface 18 of the sprayer 3 for removal of nail polish or cosmetics. When a top surface of the sprayer 3 is pressed down, the nail polish remover is dispensed via the tubing 16 and the spray hole 4 to the absorbent cleaning material 5 positioned on the adhering surface 18 of the sprayer 3. The absorbent cleaning material 5 is shaped as a natural curve of a nail also referred to as a nail curve. The nail file attachment 12 is attached to the bottom container 19 for filing nails. The cap 1 mates with the cap rim 14 of the top lid 15 for enclosing the spray attachment and preventing dust from accumulating on the adhering surface 18 and/or on the absorbent cleaning material 5. The spray bottle is made of a material such as plastic. In an embodiment, the spray bottle can be made of other materials apart from plastic.

The spray bottle containing the nail polish remover removes nail polish from nails, for example, fingernails or toenails. Initially, the cap 1 is removed from the cap rim 14 of the top lid 15 of the spray attachment of the spray bottle to expose the sprayer 3 of the spray attachment. The top lid 15 is then unscrewed and the upper container 7 is filled with the nail polish remover. The top lid 15 is then positioned on the threaded neck 2 of the top internal reservoir 20 of the upper container 7. The top lid 15 is then screwed back on the threaded neck 2 of the top internal reservoir 20 of the upper container 7. The bottom container 19 is unscrewed from the lower end of the middle container 10 and the absorbent cleaning material 5 that is placed inside the bottom container 19 is removed. The bottom container 19 is then screwed back on the lower end of the middle container 10. The absorbent cleaning material 5 is removably attached to the adhering surface 18 of the sprayer 3. When the top surface of the sprayer 3 is pressed, the sprayer 3 sprays the nail polish remover through the spray hole 4 onto the absorbent cleaning material 5, thereby saturating the absorbent cleaning material 5 with a required amount of the nail polish remover. The sprayer 3 may be pressed, for example, 1 to 2 times to force the nail polish remover via the spray hole 4 onto the absorbent cleaning material 5. The saturated absorbent cleaning material 5 is placed on the nail, for example, a fingernail or a toenail, and moved up and down and/or back and forth to clean the nail polish from the nail.

Figure 4:
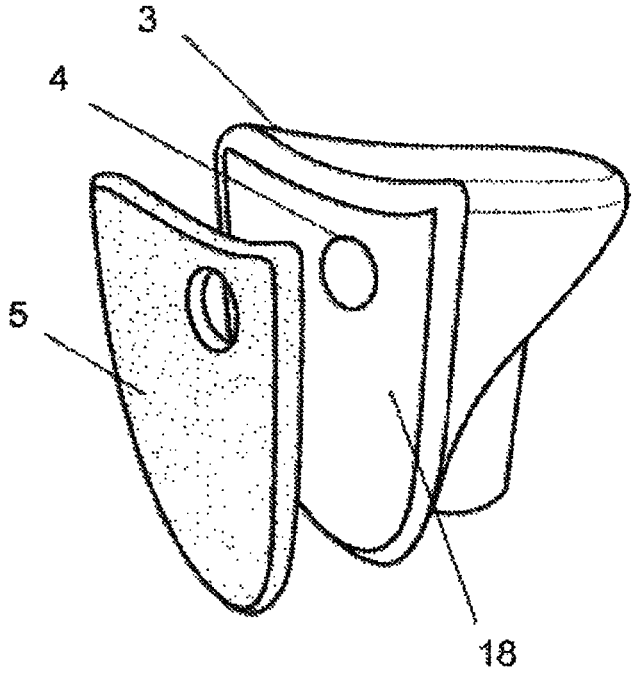
FIG. 4 exemplarily illustrates an exploded view of the spray attachment of the spray bottle.

After cleaning the nail polish from the nail, the absorbent cleaning material 5 is removed from the adhering surface 18 of the sprayer 3 as exemplarily illustrated in FIG. 4. After removing the nail polish from the nail, the spray bottle can be cleaned or sanitized. In an embodiment, the spray bottle is cleaned by pressing the sprayer 3 and spraying the nail polish remover through the spray hole 4 to a paper towel or a napkin and wiping the adhering surface 18 to remove old nail polish or nail lacquer residue. In an embodiment, the absorbent cleaning material 5 is discarded after use, for example, in a trash can. The cap 1 is then tightened around the cap rim 14 on the upper surface of the top lid 15 to enclose the sprayer 3 of the spray bottle. The nail file attachment 12 at the bottom container 19 can be used for filing the nails. After filing the nails using the nail file attachment 12, a cosmetic item such as a lotion or a cosmetic cream stored in the middle container 10 of the spray bottle is applied, for example, on hands or feet to moisturize the hands or the feet.

Figure 2:
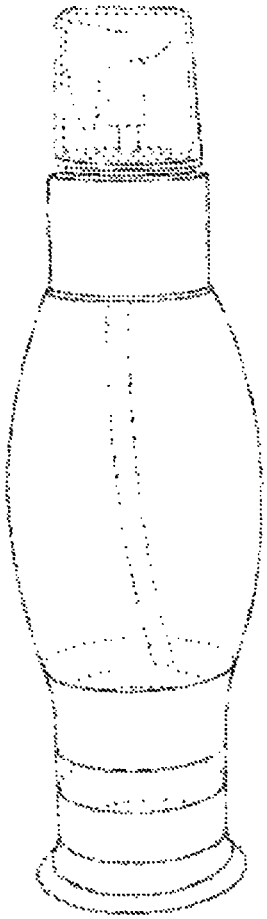
FIG. 2 exemplarily illustrates an assembled, front elevation view of the spray bottle.

FIG. 2 exemplarily illustrates an assembled, front elevation view of the spray bottle. The cap 1, the sprayer 3, the pump tube attachment 6, the upper container 7, the middle container 10, the bottom container 19, the nail file attachment 12, etc., of the spray bottle exemplarily illustrated in FIG. 2, is disclosed in the detail description of FIG. 1. After cleaning the spray bottle, the spray bottle can be stored, for example, in a purse, a drawer, or a nail station. In an embodiment without the absorbent cleaning material 5, the nail polish remover is sprayed directly on other materials, for example, cotton balls until the cotton balls are saturated. The cotton balls are then used to clean the nail polish or lacquer off the nail. After cleaning the nail polish off the nail, the middle container 10 of the spray bottle is opened to apply a cosmetic cream stored in the middle container 10 on hands or feet to moisturize the hands or the feet. The spray bottle is covered with the cap 1 to protect the sprayer 3 and the absorbent cleaning material 5 from dust.

The spray bottle can be of different sizes suitable for a required establishment. For example, the spray bottle can be of a large size for home use, a medium size for carrying in a hand bag, an office bag, etc., a small size for a keychain or for carrying on an airplane that allows a predefined amount of liquid as a part of carryon baggage. In an embodiment, the spray bottle is a disposable spray bottle to allow a sale of more units of spray bottles. In the disposable spray bottle, the upper container 7 is filled with the nail polish remover and securely closed with the top lid 15 that cannot be removed. The filled nail polish remover is securely stored in the spray bottle after closing the spray bottle with the top lid 15.

Figure 3:
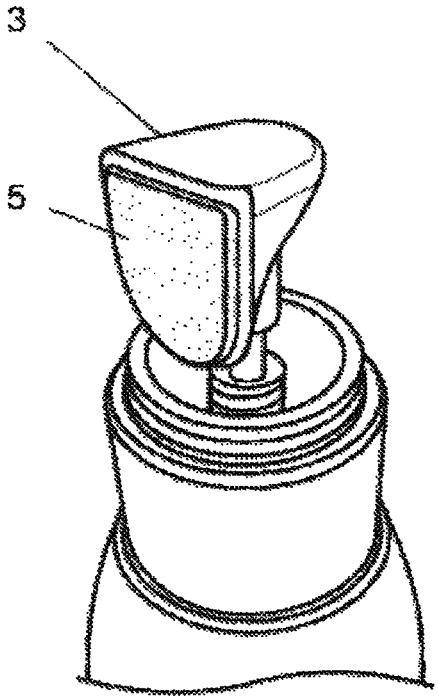
FIG. 3 exemplarily illustrates a perspective view of a spray attachment of the spray bottle, showing an absorbent cleaning material of the spray bottle.

FIG. 3 exemplarily illustrates a perspective view of a spray attachment of the spray bottle, showing an absorbent cleaning material 5 of the spray bottle. The absorbent cleaning material 5 is positioned on the sprayer 3 of the spray bottle as exemplarily illustrated in FIG. 3. In an embodiment, the sprayer 3 can be configured, for example, as a pump sprayer or a squeeze trigger sprayer. The upper container 7 can be hard or soft allowing the upper container 7 to be squeezed to release the nail polish remover. The sprayer 3 exemplarily illustrated in FIG. 3, allows the nail polish remover to be sprayed on the absorbent cleaning material 5 when the top surface of the sprayer 3 is pressed downwards.

FIG. 4 exemplarily illustrates an exploded view of the spray attachment of the spray bottle. The sprayer 3 of the spray attachment sprays the nail polish remover on a nail without spilling or ruining other adjacent painted nails. The removable absorbent cleaning material 5 eliminates germs from one user to the next user. In an embodiment, the nail polish remover can be sprayed on other material when the absorbent cleaning material 5 is not attached to the sprayer 3 of the spray bottle to remove the nail polish from the nails. The spray bottle allows the user to spray a desired amount of the nail polish remover in spray form. After cleaning the nails, the absorbent cleaning material 5 is removed from the sprayer 3 as exemplarily illustrated in FIG. 4, and discarded.

Figure 5:
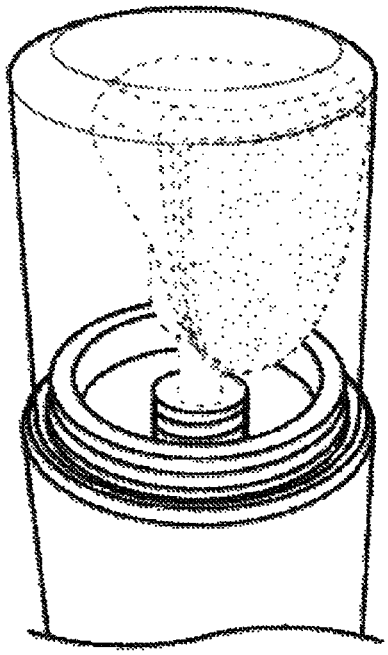
FIG. 5 exemplarily illustrates a perspective view of the spray attachment of the spray bottle, showing a sprayer enclosed by a cap of the spray bottle.

FIG. 5 exemplarily illustrates a perspective view of the spray attachment of the spray bottle, showing the sprayer 3 enclosed by the cap 1 of the spray bottle. The absorbent cleaning material 5 is attached to the adhering surface 18 of the sprayer 3. The sprayer 3 with the absorbent cleaning material 5 is covered with the cap 1 as exemplarily illustrated in FIG. 5.

The invention claimed is:

1. A spray bottle for storing a nail polish remover, a nail file attachment, and refills of an absorbent cleaning material, said spray bottle comprising:

a plurality of containers comprising an upper container, a middle container, and a bottom container, said upper container configured for storing said nail polish remover, said middle container configured for storing one or more cosmetic items, and said bottom container configured for storing said refills of said absorbent cleaning material;

said upper container comprising a top internal reservoir with a threaded neck;

said middle container comprising a middle internal reservoir, wherein said middle container is screwably attached to a lower end of said upper container;

said bottom container comprising a bottom internal reservoir, wherein said bottom container is screwably attached to a lower end of said middle container;

a spray attachment screwably attached to said top internal reservoir, said spray attachment comprising:

a top lid comprising a cap rim on an upper surface of said top lid, said top lid mating with said threaded neck of said top internal reservoir; and a sprayer comprising a pump tube attachment, said pump tube attachment coupled to a pump tube mechanism, wherein said pump tube mechanism is engaged with said top lid, a tubing attached to said top lid at a first end, said tubing immersed in said nail polish remover at a second end, said sprayer further comprising an adhering surface with a spray hole, wherein when a top surface of said sprayer is pressed down, said nail polish remover is dispensed via said tubing and said spray hole to an absorbent cleaning material positioned on said adhering surface of said sprayer;

said nail file attachment attached to said bottom container for filing nails; and a cap for mating with said cap rim of said top lid for enclosing said spray attachment and preventing dust from accumulating on said adhering surface and said absorbent cleaning material.

2. The spray bottle of claim 1 made of plastic.

3. The spray bottle of claim 1, wherein said adhering surface is shaped as a nail curve.

* * * * *